US005667273A

United States Patent [19]

Noll

[11] Patent Number: 5,667,273

[45] Date of Patent: Sep. 16, 1997

[54] SIDE TABLE AND GLIDER ASSEMBLY

[76] Inventor: Ronald C. Noll, 20749 University Boulevard, Shaker Heights, Ohio 44122

[21] Appl. No.: 658,880

[22] Filed: May 31, 1996

[51] Int. Cl.[6] ..... A47B 83/02

[52] U.S. Cl. ..... 297/171; 297/273; 297/282; 297/344.11

[58] Field of Search ..... 297/171, 135, 297/273, 281, 282, 344.11

[56] References Cited

U.S. PATENT DOCUMENTS

| | | | |
|---|---|---|---|
| D. 121,462 | 7/1940 | Tabb | 297/344.11 X |
| D. 141,705 | 6/1945 | Slaughter . | |
| D. 153,162 | 3/1949 | Nelems . | |
| D. 154,355 | 7/1949 | Allmand . | |
| D. 154,356 | 7/1949 | Allmand . | |
| D. 165,835 | 2/1952 | Glass . | |
| D. 180,458 | 6/1957 | Pearlstine . | |
| D. 265,952 | 8/1982 | Theodore . | |
| D. 281,378 | 11/1985 | Parker . | |
| D. 290,911 | 7/1987 | Pomeroy et al. . | |
| D. 298,490 | 11/1988 | Pomeroy et al. . | |
| D. 307,363 | 4/1990 | Pomeroy et al. . | |
| D. 307,523 | 5/1990 | Pomeroy et al. . | |
| D. 310,604 | 9/1990 | Pomeroy et al. . | |
| D. 325,823 | 5/1992 | Pomeroy et al. . | |
| D. 328,197 | 7/1992 | Braxton. III . | |
| D. 334,485 | 4/1993 | Pomeroy et al. . | |
| D. 338,563 | 8/1993 | Chiang . | |
| D. 350,855 | 9/1994 | Pomeroy et al. . | |
| D. 361,673 | 8/1995 | Pomeroy et al. . | |
| D. 362,349 | 9/1995 | Pomeroy et al. . | |
| D. 365,692 | 1/1996 | Pomeroy et al. . | |
| 1,845,142 | 2/1932 | Friesner | 297/282 X |
| 2,044,862 | 6/1936 | Smith . | |
| 2,179,395 | 11/1939 | Yerrick . | |
| 2,271,440 | 1/1942 | Nelems . | |
| 2,296,603 | 9/1942 | Feldman . | |
| 2,567,612 | 9/1951 | McGehee . | |
| 2,634,793 | 4/1953 | Petersen | 297/273 X |
| 2,959,210 | 11/1960 | Pearlstine | 297/344.11 |
| 3,046,053 | 7/1962 | Pearlstine | 297/344.11 |
| 3,047,334 | 7/1962 | Vanderminden . | |
| 3,078,101 | 2/1963 | Reese . | |
| 3,170,666 | 2/1965 | Reiter et al. | 297/344.11 X |
| 3,994,468 | 11/1976 | Carter . | |
| 4,213,650 | 7/1980 | Sroub . | |
| 4,398,767 | 8/1983 | McGuigan . | |
| 4,796,949 | 1/1989 | Boyce . | |

*Primary Examiner*—Peter M. Cuomo
*Assistant Examiner*—Rodney B. White
*Attorney, Agent, or Firm*—Pearne, Gordon, McCoy & Granger LLP

[57] ABSTRACT

Disclosed is a novel assembly for a glider with side tables. The glider generally comprises a bench with back and seat portions, and laterally disposed side frames which are affixed to the bench. The bench and side frames are suspended from a stationary base formed from two laterally disposed base components and a transversely extending frame member. Extending upwards from each lateral frame component is a stationary side table assembly. The side tables are configured to extend laterally outward from the sides of the glider and are stationary allowing the seat portion or bench portion of the glider to movably swing, while not interfering with such motion.

25 Claims, 5 Drawing Sheets

SIDE TABLE AND GLIDER ASSEMBLY

FIELD OF THE INVENTION

The present invention relates to a unique glider having one or more side tables.

BACKGROUND OF THE INVENTION

Gliders, also referred to as swings, are lawn or porch furniture providing single or multiple person seating that is generally suspended so that it may rock or swing.

It is desirable to provide a glider with one or more side tables for supporting food, drinks, or other items. As will be appreciated, it is necessary that such side tables be stationary and not move with the seating. Additionally, the side tables must not interfere with the swing action of the glider seat. The difficulty in adhering to these criteria is compounded by the added requirement that the resulting assembly of glider and side tables should be relatively lightweight and use a minimum of materials. This is of particular importance when the glider assembly is transported between a garage or basement, where the glider may be stored, and a patio, lawn, or porch, where the glider is typically used. Thus, there is a need for a glider that utilizes a minimum amount of materials yet provides one or more side tables that are stationary and do not interfere with the action of the glider.

A significant drawback to providing side tables for a glider is the increase in manufacturing and assembly complexity. Such increases result in greater costs and assembly time for a glider and table combination. Accordingly, there is a need for an optimized glider design that utilizes a minimum number of components and which is easy to assemble.

SUMMARY OF THE INVENTION

The present invention accomplishes all of the foregoing objectives and provides a glider assembly comprising a stationary base, two side frames suspended from the base, a bench having optional arm supports disposed between and affixed to the side frames, and at least one table assembly affixed to the base. The invention further provides several different configurations for the base and the side frames.

In another aspect, the present invention provides a glider and table assembly comprising a stationary base having first and second base members and a single frame member extending between and affixed to the base members, two side frames suspended from the base, a bench having optional arm supports affixed to the side frames and movable with the side frames, and two table assemblies affixed at opposite ends of the glider.

DESCRIPTION OF THE PREFERRED EMBODIMENTS

Figure 1:
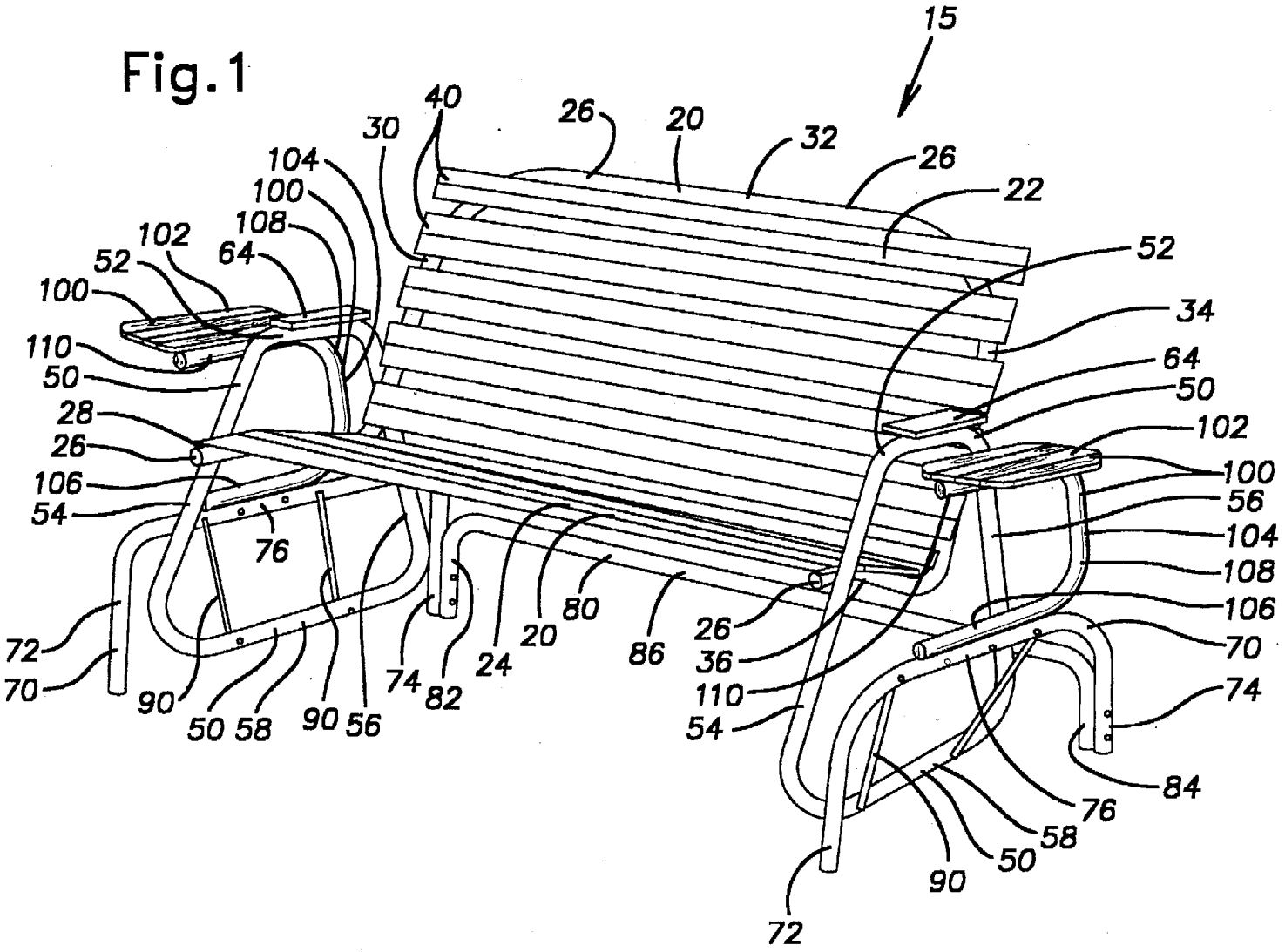
FIG. 1 is a perspective view illustrating a first preferred embodiment glider and table assembly in accordance with the present invention.

The present invention provides a novel assembly for a glider and one or more side tables. FIG. 1 illustrates a first preferred embodiment glider and side table assembly 15 in accordance with the present invention. The glider 15 assembly comprises a bench 20, two side frames 50, two lower lateral bases 70 interconnected by a rear base 80, and two side table assemblies 100.

The bench 20 comprises a back member 22 adjoined to a seat member 24. The bench 20 utilizes a bench frame 26, preferably in the form of a single continuous bent tube, that provides support for both the seat 24 and the back 22. The bench frame 26 comprises a first seat side portion 28, a first back side portion 30, a back top portion 32, a second back side portion 34, and a second seat side portion 36. Support surfaces for the back and seat 22 and 24, respectively, are provided by a plurality of spaced panels 40 as shown in FIG. 1. The panels 40 preferably extend from the first seat side portion 28 to the second seat side portion 36, and between the first back side portion 30 and the second back side portion 34. The panels 40 preferably extend parallel to the back top portion 32. The panels 40 can be formed from a wide array of materials. The materials employed should be sufficiently strong to support the weight of the users of the glider, be weather resistant or treated to be such, lightweight, and amenable to incorporation in the glider assembly 15. A preferred class of materials for the panels 40 is wood. End caps (not shown) may be provided in the open ends of the frame 26 when the frame 26 is formed from a bent tube.

Affixed to each lateral end of the bench 20 is the side frame 50 that is preferably in the form of a single continuous bent tube, most preferably in the shape of a trapezoid. The frame 50 is preferably closed, i.e. its ends joined to one another. Alternatively, if the frame 50 is not closed, end caps (not shown) can be inserted into the ends of the frame 50, or the ends left open. The side frame 50 comprises an upper region 52 and a lower region 58, the upper and lower regions of the frame 50 preferably being parallel with one another. Extending between the upper region 52 and the lower region 58 of the frame 50 are a forward region 54 and a rearward region 56. As illustrated in FIG. 1, both the forward region 54 and the rearward region 56 preferably slope inwards towards each other as they extend from the lower region 58 to the upper region 52 thereby forming the frame 50.

Optionally affixed to the upper region 52 of the side frame 50 is an arm support 64. The arm support is preferably a flat, planar member such as a portion of the previously noted panel 40. The arm support 64 can be affixed to the side frame 50 by a variety of techniques, such as for instance by threaded fasteners extending between the arm support and the frame 50.

The bench 20 and the side frames 50 are affixed to one another and as explained in greater detail below, constitute the swinging or movable portion of the glider assembly. The side frames 50 are preferably affixed to the bench 20 by welding or utilizing threaded fasteners. As illustrated in FIG. 1, each side frame 50 is preferably affixed to the bench 20 at two locations. The first affixment location is the point of contact between the forward region 54 of the side frame 50 and the first or second seat side portions 28 or 36, respectively, of the bench frame 26. The second affixment location is the point of contact between the rearward region 56 of the frame 50 and the first or second back side portions 30 or 34 respectively, of the frame 26. Other affixment techniques can be utilized instead of or in addition to welding or employing threaded fasteners.

The bench 20 and the side frame 50 assembly is movably suspended from a stationary glider frame comprising two lower lateral bases 70, each disposed proximately and below each end of the bench 20, and the rear base 80 extending between the pair of lower lateral bases 70. Preferably, the base 80 is perpendicularly oriented to the lower lateral bases 70, and extends along the rear of the glider assembly 15.

Each lower lateral base 70 comprises a forward leg section 72, a rearward leg section 74, and an upper section 76 generally extending between the legs 72 and 74. The rear base 80 comprises a rear vertical base segment 82, a rear vertical base segment 84, and a rear horizontal base segment 86 extending between the segments 82 and 84. The base 80 and the lower lateral bases 70 are affixed to one another to form a rigid one piece assembly. Preferably, at one end of the glider, the rearward leg section 74 is affixed to the rear vertical base segment 82, and at the other end, the rearward leg section 74 is affixed to the rear vertical base segment 84. Affixment may be accomplished by welding or threaded fasteners for example.

The bench 20 and the side frames 50 are suspended from the assembly of base components 70 and 80 by a plurality of suspending bands 90. Preferably, one or more bands 90 are affixed between the upper section 76 of the lower lateral base 70 and the lower region 58 of the side frame 50. Affixment between a band 90 and the lower lateral base 70 and the side frame 50 is such that the glider bench 20 and the side frames 50 can be moved relative to the stationary glider base components 70 and 80. Preferably, such affixment is achieved by a bushing and fastener assembly utilized at each point of affixment of the bands 90. The suspending bands 90 are preferably in the form of metallic straps, however other materials and other configurations are contemplated. For instance, although the glider assembly illustrated in FIG. 1 is shown to utilize two suspending bands 90 on each side, it is contemplated that a lesser or greater number could be used and that the bands 90 could be formed from an elastomeric material.

The preferred embodiment assembly 15 also comprises the side table assembly 100 disposed on each end of the glider as shown. The side table assembly 100 comprises a table 102 secured to or otherwise affixed to a bracket 104. The bracket 104 preferably provides a lower portion 106, an upper portion 110, and an extension portion 108 extending between the upper and lower portions 110 and 106, respectively. The bracket 104 is preferably secured to the upper section 76 of the lower lateral base 70 along the lower portion 106 of the bracket 104. The table 102 can be formed from a wide array of materials. Preferably, the table is formed from one or more portions of the panels 40 employed in the glider bench. The table 102 is affixed to the upper portion 110 of the bracket 104 by one or more threaded fasteners.

Figure 2:
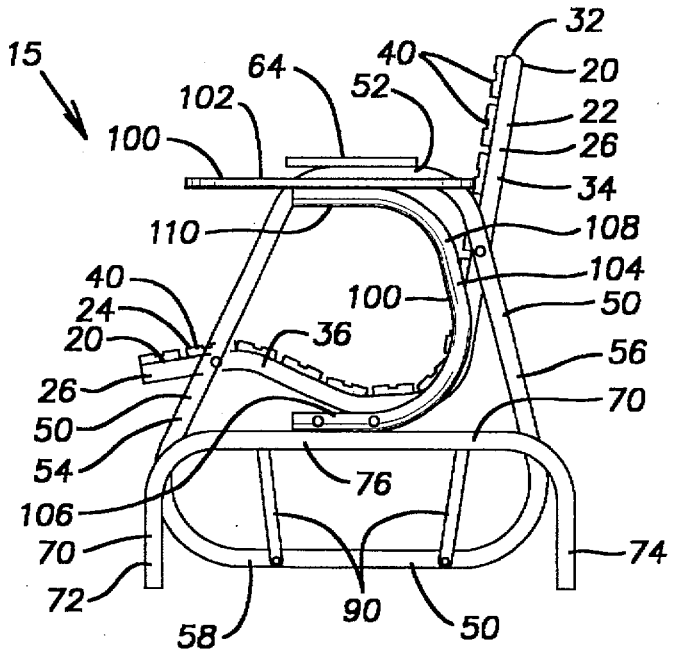
FIG. 2 is a side elevational view of the first preferred embodiment illustrated in FIG. 1.

FIG. 2 is a side elevational view of the first preferred embodiment glider and side table assembly 15. FIG. 2 illustrates in greater detail the preferred trapezoidal shape of the side frame 50. FIG. 2 also illustrates a preferred configuration for the side table bracket 104, referred to herein as rearwardly sweeping. That is, the bracket 104 is preferably configured so that the upper and lower portions 110 and 106 respectively, are parallel to one another, the extension portion 108 is angled so that it is slightly directed toward the front of the glider as it extends upwards, and the curved regions of the bracket 104 are proximate to the rear of the glider. The present invention also includes an embodiment in which the side table bracket 104 is configured so that it is forwardly sweeping, i.e. so that the extension portion 108 is directed toward the rear of the glider as portion 108 extends upward, and the curved regions of the bracket 104 are proximate to the front of the glider. The preferred profile configuration for the seat member 24 is also shown in FIG. 2. The seat member 24 preferably slopes upward from the rear of the glider and then gradually angles downward at approximately the point of affixment to the forward region 54 of the side frame 50.

Figure 3:
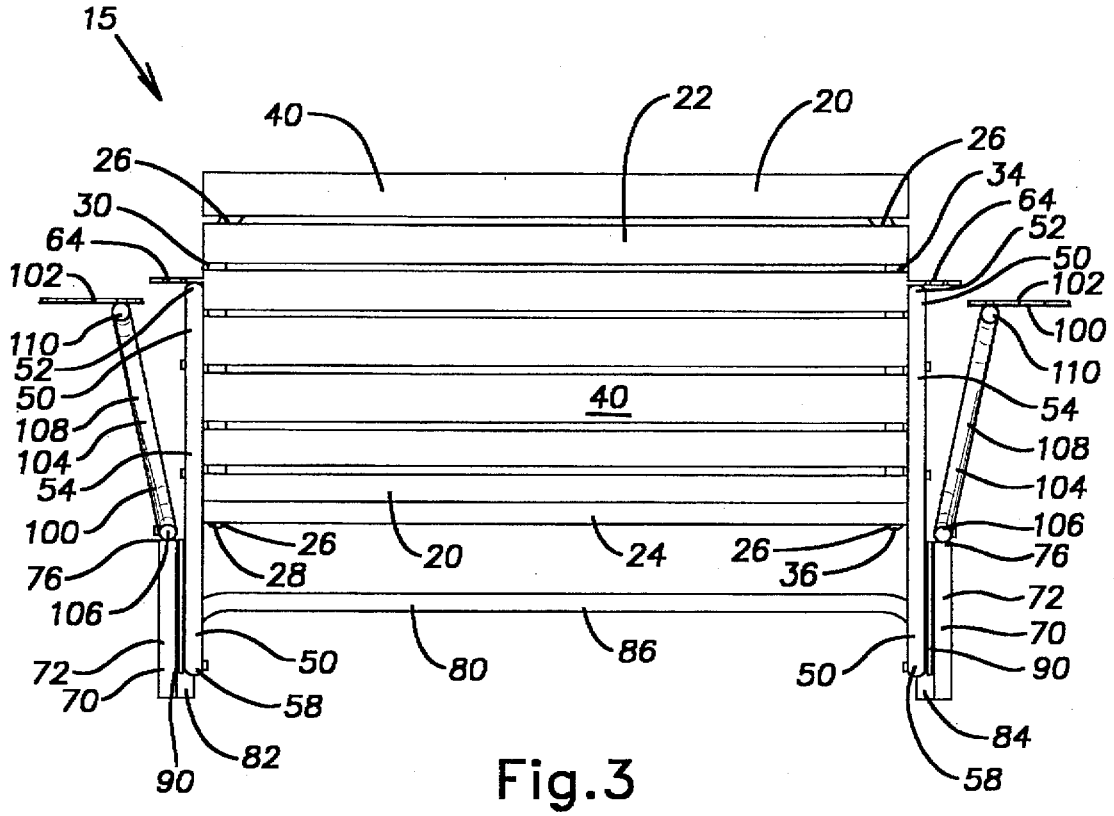
FIG. 3 is a front elevational view illustrating the first preferred embodiment illustrated in FIG. 1.

FIG. 3 is a front elevational view of the first preferred embodiment glider assembly 15. It is evident from FIG. 3 that the side frames 50 and the lower lateral bases 70 are approximately parallel to one another in the vertical direction, and further that the suspending bands 90 are disposed between them. Each side table assembly 100, i.e. table 102 and bracket 104, is preferably affixed to the lower lateral base 70 so that the table assembly 100 extends laterally outward from the glider. This is significant and important so that the side table assembly 100 does not interfere with the rocking or swinging motion of the bench 20 or side frames 50. Moreover, this allows room for items to be placed upon the table 102 without interfering with the motion of the glider. Each side table assembly 100 may be affixed to the glider at angles other than those shown. It can also be seen from FIG. 3 that the table assembly 100 is angled laterally outward so that the table 102 is not disposed underneath the arm support 64. This configuration enables maximum usage of the upper surface of the table 102.

Figure 4:
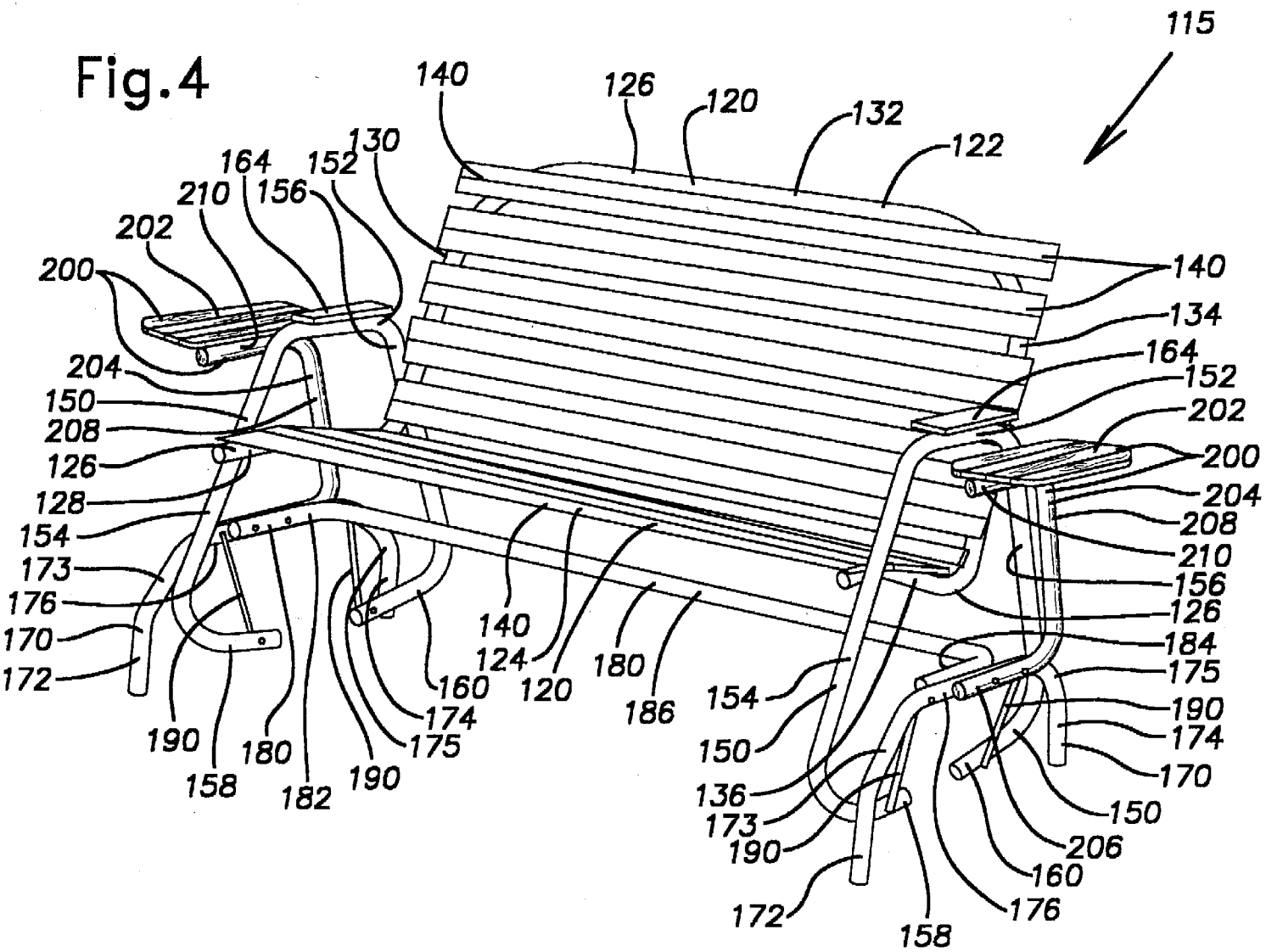
FIG. 4 is a perspective view of a second preferred embodiment glider and table assembly in accordance with the present invention.

FIG. 4 is a perspective view of a second preferred embodiment glider and table assembly 115 in accordance with the present invention. The second preferred embodiment assembly is similar to the previously described first preferred embodiment assembly 15, however utilizing a different side frame, lower lateral base assembly, and side table assembly. The second preferred embodiment glider and side table assembly 115 comprises a bench 120, two side frames 150, a frame formed from two lower lateral bases 170 and a rear base 180, and two side table assemblies 200 disposed at each end of the glider. The bench 120 comprises a back member 122 and a seat member 124. The bench 120 utilizes a bench frame 126 preferably formed from a single, continuous bent tube. The bench frame 126 includes a first seat side portion 128, a first back side portion 130, a back top portion 132, a second back side portion 134, and a second seat side portion 136. Extending between the first seat side portion 128 and second seat side portion 136 are a plurality of spaced panels 140. The panels 140 also preferably extend between the first and second back side portions 130 and 134. The materials for the panels 140 are preferably the same as for the previously described panels 40 utilized in the first embodiment glider assembly 15.

Each side frame 150 is preferably formed from a single continuous bent tube. The side frame 150 differs from the previously described frame 50 in that the side frame 150 has an open region as shown in FIG. 4 along a lower portion of the frame 150. As described in greater detail below, the frame 150 also has a different aspect ratio, i.e. ratio of height to width, than the previously described frame 50. The side frame 150 includes an upper region 152, a forward region 154 and a rearward region 156. The open portion of the frame 150 is defined between a lower front horizontally extending region 158 and an opposing lower rear region 160.

The ends of the side frame 150, i.e. terminating at regions 158 and 160, can be fitted with end caps.

Optionally affixed to the upper region 152 of the side frame 150, is an arm support 164. The arm support 164 is preferably a table such as formed from one or more panels 140. The arm support 164 can be secured to the side frame 150 as the previously described affixment of the arm support 64 to the frame 50 in the first preferred glider assembly 15.

The lower lateral base 170 differs from the previously described base 70 in that the base 170 has a different configuration or shape and, in most respects is shorter than the base 70. The lower lateral base 170 preferably comprises five straight sections as opposed to the U-shaped configuration of base 70. The base 170 comprises a forward leg section 172, a forward angled section 173, a rearward leg section 174, a rearward angled section 175, and an upper section 176 extending between the angled sections 173 and 175.

Extending between each lower lateral base 170 is the rear base member 180. Preferably, the base member 180 is perpendicularly oriented with respect to the lower lateral bases 170, and extends along the rear of the glider assembly 115. The rear base 180 comprises a first lateral base segment 182, a second lateral base segment 184, and a rear base segment 186 extending between the segments 182 and 184 as shown in FIG. 4. Preferably, the first lateral base segment 182 is affixed to the upper section 176 of a first lower lateral base 170, and the second lateral base segment 184 is affixed to the upper section 176 of a second lower lateral base 170. The base 180 is secured or affixed to the lower lateral bases 170 as previously described with respect to the base components 70 and 80 of the first glider embodiment 15. Comparing this frame configuration to that of the first glider embodiment 15, it is important to note that the rear base 180 of the second glider embodiment 115 is oriented in a horizontal plane whereas the rear base 80 of the first glider embodiment 15 is oriented in a vertical plane.

The bench 120 and the side frames 150 are preferably affixed to one another and form an integral one piece assembly which constitutes the movable portion of the glider. That assembly is suspended from the previously described base 170 and 180 by a plurality of suspending bands 190 disposed along the sides of the assembly 115. As previously noted with regard to the first preferred embodiment 15, it is contemplated that a lesser or greater number of bands 190 may be employed to provide for the movable action of the bench 120 and side frames 150. With respect to the bands 190, the previously presented description pertaining to the bands 90 in the first glider embodiment 15 applies.

The second preferred embodiment assembly 115 preferably comprises two side table assemblies 200 as shown in FIG. 4. Each side table assembly 200 comprises a table 202 affixed to a bracket 204. The bracket 204 has a lower portion 206, an upper portion 210, and an extension portion 208 extending between the upper and lower portions 210 and 206, respectively. The bracket 204 is affixed to the upper section 176 of a lower lateral base 170. The table 202 is formed from the same materials as described for the table 102 in the first preferred glider assembly 15.

Figure 5:
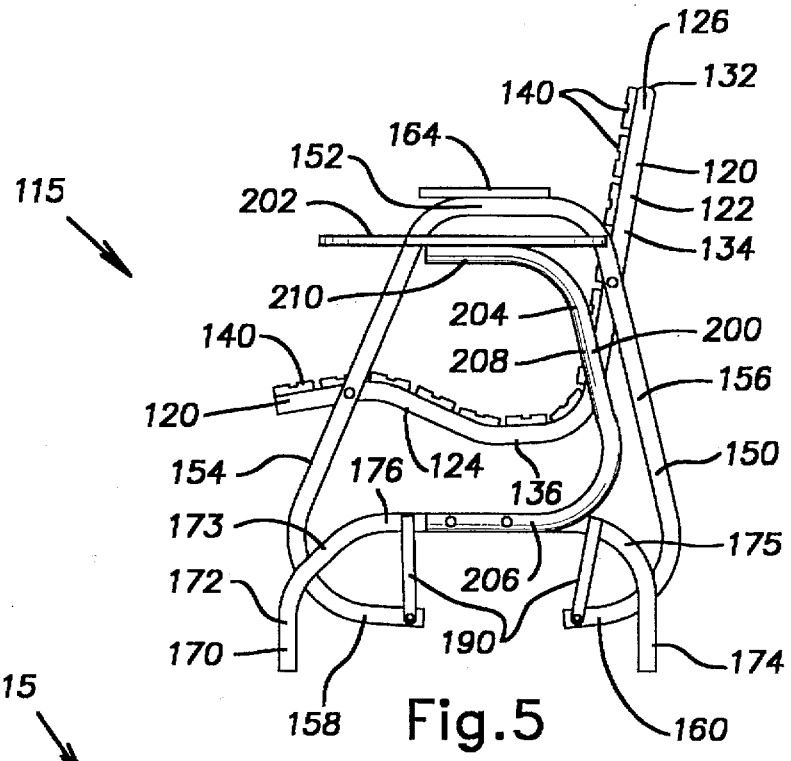
FIG. 5 is a side elevational view of the second preferred embodiment assembly illustrated in FIG. 4.

FIG. 5 is a side elevational view of the second preferred embodiment glider and side table assembly 115. FIG. 5 illustrates the preferred configuration of the side frame 150 and the lower lateral base 170. It can be seen that the side frame 150 extends upwards from below the upper section 176 of the lower lateral base 170 to approximately mid-level of the bench back 122. Upon close comparison of the side frame 150 to the side frame 50 of the first glider assembly 15, it will be noticed that the frame 150 has a greater ratio of height to width than the frame 50. That is, for side frames 150 and 50 having bases of equal width, the frame 150 has a greater height than the frame 50. Moreover, it can be seen that the lower lateral base 170 is relatively short, extending only approximately one-half the distance to the underside of the bench seat 124. That is, the base 170 extends upward a distance of about one-half the distance between the seat portion of the bench and the lowermost region of the side frame 150. In contrast, the base 70 of the first preferred embodiment glider assembly 15 extends upwards approximately the same distance from the ground as the bench seat 24. That is, the base 70 extends upward a distance about equal to the distance between the seat portion of the bench and the lowermost region of the side frame 50.

FIG. 5 further illustrates a preferred configuration for the side table bracket 204. Preferably, the upper and lower portions 210 and 206 respectively, are parallel to one another, and the extension portion 208 is angled so that it extends forwardly as shown. In this preferred configuration referred to herein as rearwardly sweeping, shown in FIG. 5, the angled portions of the bracket 204 are disposed near the rear of the glider. The present invention also includes an embodiment in which the bracket 204 is forwardly sweeping, i.e. wherein the extension portion 208 is directed toward the rear of the glider and the angled portions of the bracket are proximate to the front of the glider. The bracket 204 differs from the bracket 104 utilized in the first glider 15 in that the bracket 204 utilizes a relatively long extension portion 208 as compared to the extension portion 108 of the bracket 104. Moreover, the bracket 104 has a more arcuate configuration than the angular bracket 204.

Figure 6:
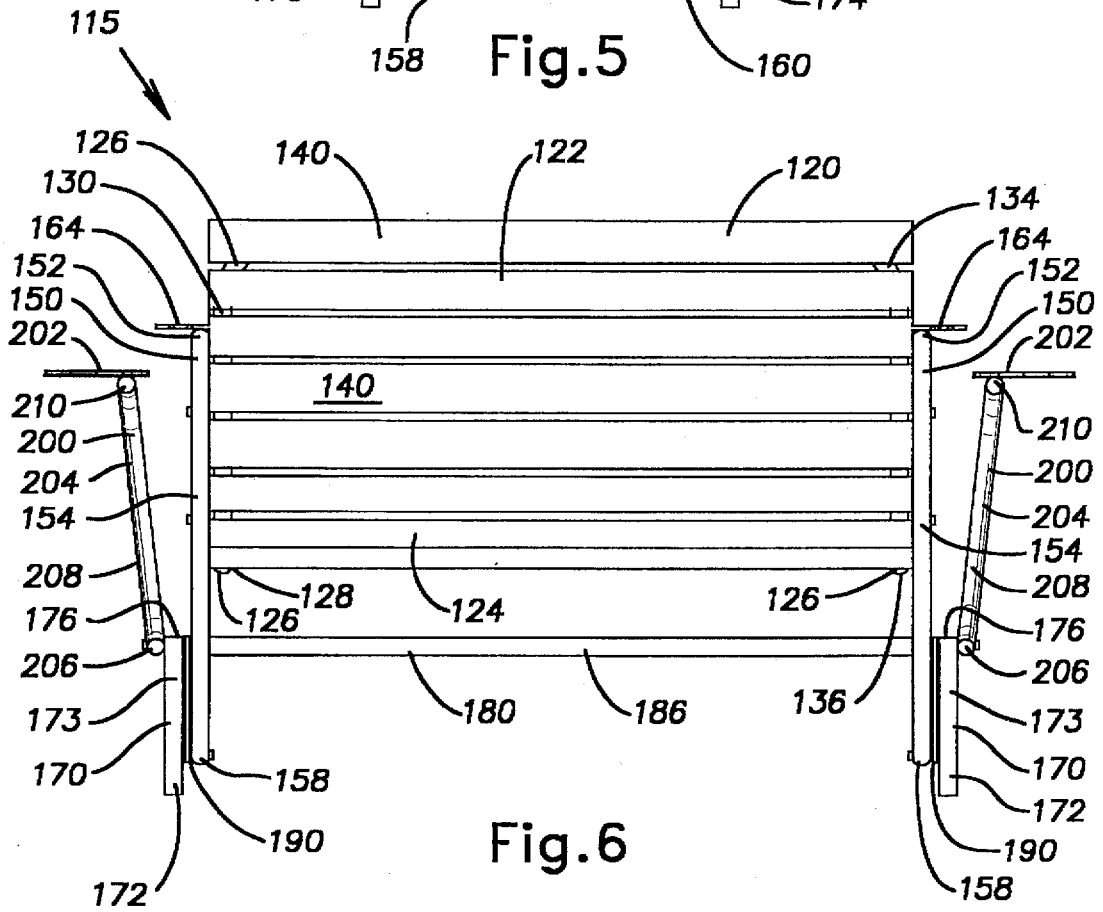
FIG. 6 is a front elevational view of the second preferred embodiment illustrated in FIG. 4.

FIG. 6 is a front elevational view of the second preferred embodiment glider assembly 115. It can be seen from FIG. 6 that the side table assemblies 200 preferably extend laterally outward from the sides of the glider. As previously noted with respect to the first embodiment glider assembly 15, it is preferred that the side table assemblies 200 extend laterally outward from the glider and not interfere with the rocking action of the glider. It is also evident from FIG. 6 that the side frame 150 and the lower lateral base 170 are preferably parallel to one another with the suspending bands 190 disposed and extending between them.

Figure 7:
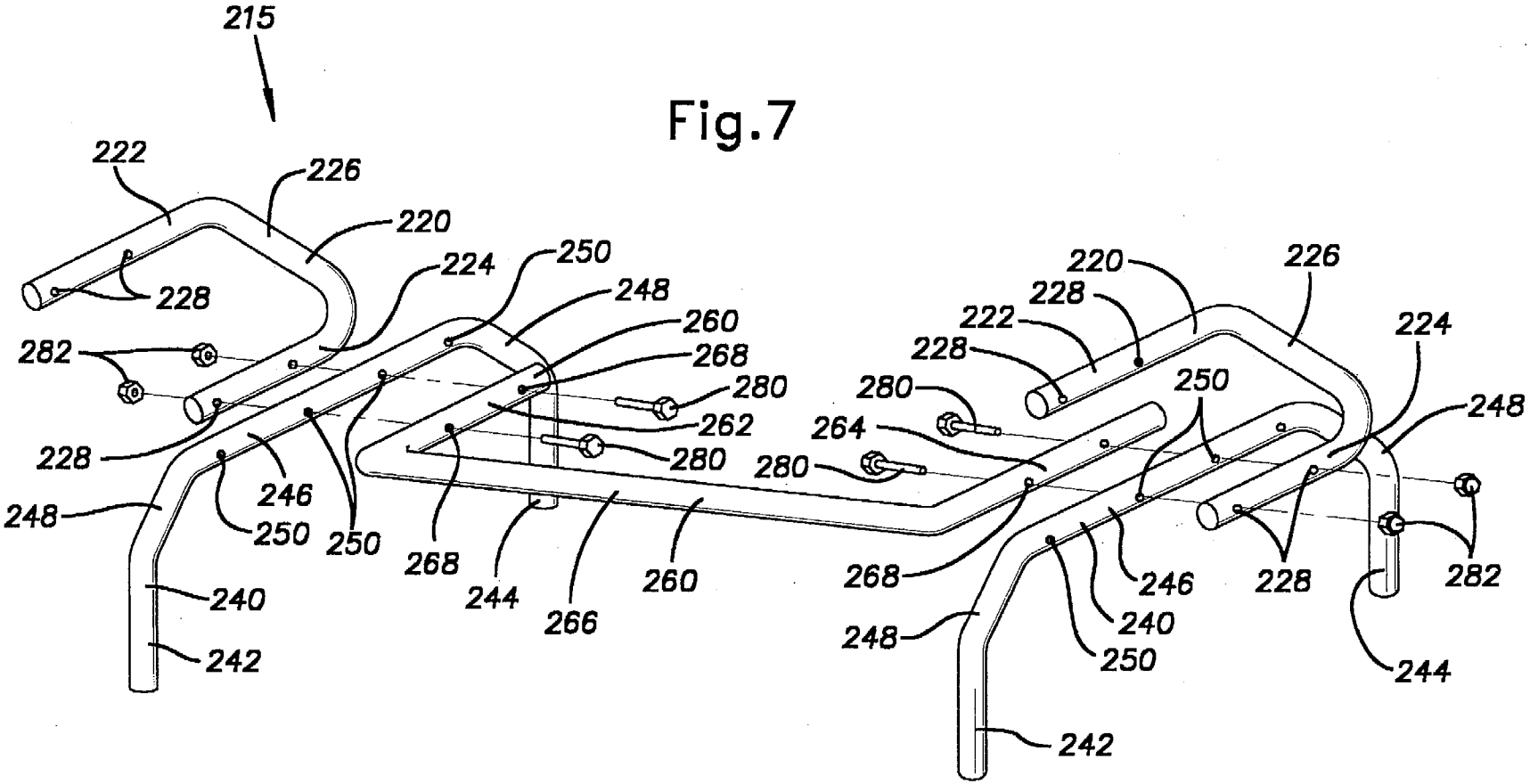
FIG. 7 is an exploded view of a third preferred embodiment glider frame and table bracket assembly in accordance with the present invention.

FIG. 7 illustrates a third preferred embodiment glider base and side table bracket assembly 215 in accordance with the present invention. FIG. 7 is an exploded view of these components and illustrates a preferred technique for securing the members together. The third preferred embodiment assembly 215 comprises two side table brackets 220, two lateral base members 240, and a transverse base member 260 extending between the lateral base members 240.

Each side table bracket 220 comprises an upper section 222, a lower section 224, and an intermediate section 226 extending between the upper and lower sections 222 and 224, respectively. As illustrated in FIG. 7, the upper and lower sections 222 and 224 are preferably parallel to one another. Moreover, the upper section 222 extends significantly beyond the distal end of the lower section 224.

Each lateral base member 240 comprises a first leg 242, a second leg 244, and a horizontal segment 246 joining the legs 242 and 244 by two angled connector segments 248.

Extending between the two lateral base members 240 is the transverse base member 260. The base member 260 comprises a first connector portion 262, a second connector portion 264, and a middle portion 266 extending between the first and second connector portions 262 and 264, respectively.

The transverse base member 260 is affixed to the two lateral base members 240 by one or more fasteners 280 extending through apertures 250 defined in the lateral base members 240 and apertures 268 defined in the transverse base member 260. The one or more fasteners 280 are retained by a corresponding number of retainers 282, which are preferably in the form of conventional threaded nuts. Each bracket 220 is preferably also affixed to a lateral base member 240 and/or the transverse base member 260, most preferably by the same previously noted fasteners 280 and retainers 282 extending through apertures 228 defined in the brackets 220.

The third preferred embodiment assembly 215 illustrated in FIG. 7 can be incorporated in a glider assembly such that the legs 242 are disposed at the glider front or instead, at the glider rear. Furthermore, the brackets 220 may be reversed so that the region of intersection between sections 224 and 226 is proximate to the legs 242 instead of the legs 244 as shown. Moreover, the transverse base member 260 can be reversed in combination with the foregoing variations such that the first and second portions 262 and 264 are disposed proximate to the legs 242 instead of the legs 244 as shown in FIG. 7.

In addition to, or as an alternative to utilizing threaded fasteners and nuts or retainers, it is contemplated that the various frame components could be affixed to one another by other techniques known in the art such as for instance, but not limited to, welding, brazing, or bonding with adhesive materials.

In all of the foregoing embodiments, the frame for the glider base, the bench, or the side table bracket can be made from a variety of materials, including but not limited to steel, aluminum, wood, and plastic. Steel tubing is generally preferred, typically in the form of from about 1" to about 1-½" tubing having a gauge of about 16 to 19. The material selected for the glider frame or side table brackets is preferably treated or otherwise provided with a layer or coating of weather protectant material. For steel tubing, it is preferred to flowcoat or powder coat the exterior surfaces.

As previously noted, the panels 40 and 140 and arm supports 64 and 164 in the first and second preferred embodiments can be formed from a wide array of materials such as for instance wood. Examples of suitable wood include but are not limited to cedar, mahogany, pine, redwood and oak. It is also contemplated that other materials may be utilized instead of or in addition to wood. Examples of such materials include plastic and fiberglass.

Moreover, the present invention glider and table assembly includes a glider as previously described, having one or more side tables disposed along and affixed to the ends of the glider by utilizing one or more relatively straight table brackets instead of the arcuate or angled brackets 104 and 204 as previously noted. Such straight brackets may be affixed to an upper portion of a lateral base member, such as section 76 or 176 of the previously disclosed lower lateral bases 70 and 170, respectively.

Furthermore, while the foregoing details are what is felt to be the preferred embodiments of the present invention, no material limitations to the scope of the claimed invention are intended. Further, features and design alternatives that would be obvious to one of ordinary skill in the art are considered to be incorporated herein. The scope of the invention is set forth and particularly described in the claims herein below.

What is claimed is:

1. A glider assembly comprising:

a stationary base having a front and a rear, said base consisting of two laterally disposed base members and a transversely extending frame member, said frame member disposed proximate to said rear of said stationary base;

two side frames, each movably affixed and suspended from said laterally disposed base members;

a bench having an upwardly extending back portion adjoined to a generally horizontal seat portion, said bench disposed between and affixed to said two side frames; and at least one table assembly having an upwardly extending bracket having an upper portion, said bracket affixed to an uppermost region of one of said laterally disposed base members, and a table secured to said bracket wherein said upper portion of said bracket is vertically spaced above said uppermost region of said laterally disposed base member to which said bracket is affixed.

2. The glider assembly of clam 1 wherein said transversely extending frame member comprises at least one section oriented in a generally vertical plane.

3. The glider assembly of claim 1 wherein said transversely extending frame member comprises at least one section oriented in a generally horizontal plane.

4. The glider assembly of claim 1 wherein each of said side frames has a trapezoidal configuration.

5. The glider assembly of claim 1 wherein said side frames are suspended from said base members by a plurality of suspending bands.

6. The glider assembly of claim 1 wherein said bench further has a plurality of panels extending between said side frames to which said bench is affixed.

7. The glider assembly of claim 1 wherein said assembly defines a span between said seat portion of said bench and a lowermost region of said side frames, said base members are disposed below said bench and extend upwards a distance of about one-half said span between said seal portion of said bench and a lowermost region of said side frames.

8. The glider assembly of claim 1 wherein said assembly defines a span between said seat portion of said bench and a lowermost region of said side frames, said base members extend upwards a distance about equal to said span between said seat portion of said bench and a lowermost region of said side frames.

9. The glider assembly of claim 1 wherein said base members each have a U-shaped configuration.

10. The glider assembly of claim 1 wherein said base members comprise five adjoining straight sections.

11. The glider assembly of claim 1 wherein at least one of said two base members, said transversely extending frame member, said two side frames, and said table brackets is formed from a metal tube.

12. The glider assembly of claim 11 wherein all of said members, frames, and brackets are formed from metal tubing.

13. The glider assembly of claim 1 wherein said upwardly extending bracket is rearwardly sweeping.

14. The glider assembly of claim 1 wherein said upwardly extending bracket is forwardly sweeping.

15. The glider assembly of claim 1 wherein said upwardly extending bracket is straight.

16. A glider and table assembly having a front and a rear, said assembly comprising:

a stationary base having a first base member, a second base member, and a single frame member extending between and affixed to said first base member and said second base member, said single frame member disposed along said rear of said assembly;

a first side frame suspended from and movably affixed to said first base member;

a second side frame suspended from and movably affixed to said second base member;

a bench disposed between and affixed to said first side frame and said second side frame;

a first table assembly having a first upwardly extending bracket affixed to an uppermost portion of said first base member and a first table affixed to an upper region of said first bracket wherein said upper region of said first bracket is vertically spaced above said uppermost portion of said first base member; and a second table assembly having a second upwardly extending bracket affixed to an uppermost portion of said second base member and a second table affixed to an upper region of said second bracket.

17. The glider assembly of claim 16 wherein each of said side frames has a trapezoidal configuration.

18. The glider assembly of claim 16 wherein said assembly defines a span between said seat portion of said bench and a lowermost region of said side frames, said first and second base members extend upwards a distance of at least about one-half said span between said seat portion of said bench and a lowermost region of said side frames.

19. The glider assembly of claim 16 wherein said assembly defines a span between said seat portion of said bench and said lowermost region of said side frames, said first and second base members extend upwards a distance about equal to said span between said seat portion of said bench and said lowermost region of said side frames.

20. The glider assembly of claim 16 wherein said base members each have a U-shaped configuration.

21. The glider assembly of claim 16 wherein said base members comprise five adjoining straight sections.

22. The glider assembly of claim 16 wherein at least one of said upwardly extending brackets is rearwardly sweeping.

23. The glider assembly of claim 16 wherein at least one of said upwardly extending brackets is forwardly sweeping.

24. The glider assembly of claim 16 wherein at least one of said upwardly extending brackets is straight.

25. A glider and side table assembly comprising:

a first base member providing two vertically extending leg portions and a horizontal portion extending between said two leg portions;

a second base member providing two vertically extending leg portions and a horizontal portion extending between said two leg portions;

a third base member extending between and affixed to said first base member along one of said vertically extending leg portions of said first base member, and affixed to said second base member along one of said vertically extending leg portions of said second base member;

a first side frame movably secured to said first base member;

a second side frame movably secured to said second base member;

a bench having a back portion and a seat portion, said bench disposed between and affixed to said first and second side frames;

a first table bracket directly affixed to said horizontal portion of said first base member, said first table bracket having a distal end disposed above said seat portion of said bench and above said horizontal portion of said first base member;

a second table bracket directly affixed to said horizontal portion of said second base member, said second table bracket having a distal end disposed above said seat portion of said bench and above said horizontal portion of said second base member; and two relatively flat and planar tables, each affixed to a distal end of said first and second table brackets.

* * * * *